US006026578A

United States Patent [19]

Brenner

[11] Patent Number: 6,026,578

[45] Date of Patent: Feb. 22, 2000

[54] WEIGHTED HANDLE FOR RAZORS

[76] Inventor: Mark L. Brenner, 3807 Alomar Dr., Sherman Oaks, Calif. 91423

[21] Appl. No.: 08/965,058

[22] Filed: Nov. 5, 1997

[51] Int. Cl.[7] ..... B26B 21/52

[52] U.S. Cl. ..... 30/537; 30/526

[58] Field of Search ..... 30/50, 526, 532, 30/535, 537

[56] References Cited

U.S. PATENT DOCUMENTS 2,264,323 12/1941 Monnet ..... 30/526 X
2,645,009 7/1953 Cohen ..... 30/537 X

*Primary Examiner*—Douglas D. Watts
*Attorney, Agent, or Firm*—Darby & Darby

[57] ABSTRACT

A razor handle for any of a wide variety of disposable shavers sold. The handle device provides greater stability, weight and balance, which in turn provides increased "feel" to the user resulting in a closer and smoother shave, and a resultant decrease in the number of cuts or nicks to the face or leg, etc. The handle device consists of a tubular member for receiving therein and securely locking in place a variety of disposable razors with different dimensional configurations. The handle device is weighted to increase the "feel" of the razor. Additionally, by adding or reducing weights, the user may vary the "feel" of the razor to suit his or her particular preference.

7 Claims, 1 Drawing Sheet

WEIGHTED HANDLE FOR RAZORS

BACKGROUND OF THE INVENTION

1. Field of the Invention

The present invention relates to razors used for shaving. More particularly, the present invention relates to a handle for disposable razors optionally provided with a weight or weight therein. The provision of a weight or weights in the handle of the present invention, and the handle attachment itself, yields greater stability, weight, length and balance than an ordinary disposable razor would otherwise provide. The added stability, weight, length and balance provides to the user increased "feel," such that the contours of the face, leg, etc. are better sensed, thus reducing the likelihood of cuts and nicks to the face, leg, etc.

2. Discussion of the Related Art

U.S. Pat. No. 4,905,372 to Willis entitled "Razor Handle Extension" discloses a razor handle extension connected to the handle of a disposable razor to effectively increase the length of the disposable razor handle, such that a female user may shave her lower leg from a standing, substantially straight-legged position. As Willis has as its object to increase the effective length of the handle, the disposable razor of Willis is not inserted substantially within the handle extension. Thus, because the added length contributes to the instability of the razor blade against the user's leg, this patent suffers from the drawback of not stabilizing the razor. As a result, the user of the handle extension lacks sufficient "feel" for the razor blade against the skin, such that cuts or nicks are likely to result.

U.S. Pat. No. 5,107,590 to Burout, III et al. entitled "Razor Handle" discloses a razor handle having a weight therein, but nonetheless suffers from the drawback of not being utilizable with a disposable razor having a full length handle. Instead, the Burout patent requires a detachable razor head, and would not be suitable for use with an ordinary light-weight disposable razor. Further, Burout teaches the use of only a single weight, wherein the single weight is not positionable at varying locations within the handle. Thus, Burout suffers from the drawback of providing a very narrow degree of added control.

Ordinary disposable razors suffer from the drawback of being too light and, thus, unstable. The devices of the above-described patents suffer from the drawback of having a complex assembly, and of not being able to function universally with disposable-type razors having handles of a variety of different shapes and sizes. These deficiencies result in, among other things, insufficient "feel" being transmitted to the user of the razor, which in turn frequently results in cuts and nicks to the face or leg, etc.

SUMMARY OF THE INVENTION

Accordingly, it is an object of the present invention to provide a handle device for any of the wide variety of disposable razors.

It is a further object of the invention to provide a handle which is universal, i.e., which may be used with any of the types of disposable blade-type razors sold, regardless of brand and regardless of whether the razor is designed for men or women.

It is yet a further object of the present invention to provide a handle device which is long lasting, such that it may be used for many years, notwithstanding that the razors with which the handle is used may be disposed of in a matter of days.

It is yet a further object of the present invention to provide a handle device for disposable blade-type razors which results in the shaver having an increased weight or feel, or "weight-feel," for the contours of the face or leg, etc., being shaved.

It is yet a further object of the present invention to provide a handle device for disposable blade-type razors which itself has a substantial weight, and where the handle weight may be increased by inserting one or more weights or weighted discs. The weight of the handle, and the provision for at least one additional weight or weighted disc, allows the user to shave without struggling to determine how much pressure to apply to the skin.

It is yet another object of the present to provide a handle device for disposable blade-type razors which results in a smoother shave and decreased instances of cuts or nicks to the skin.

In accordance with the preferred embodiment demonstrating further objects, features and advantages of the present invention, the handle comprising a tube, the tube having a top end and a bottom end and having a length between said top end and said bottom end sufficient to receive therein substantially the entire razor handle inserted in the tube, and means for securing the elongated razor handle in said tube.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings, wherein like reference numerals designate like components, and wherein.

DETAILED DESCRIPTION OF THE PRESENTLY PREFERRED EXEMPLARY EMBODIMENT

Figure 1:
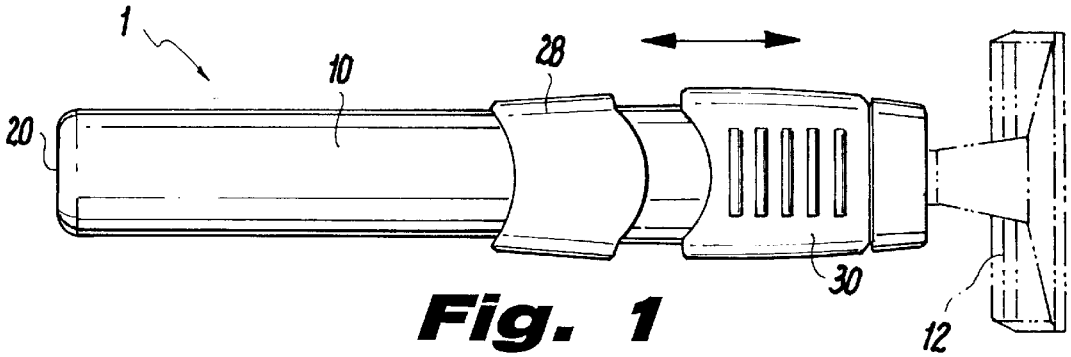
FIG. 1 is a front plan view of a weighted handle device according to the present invention.
Figure 2:
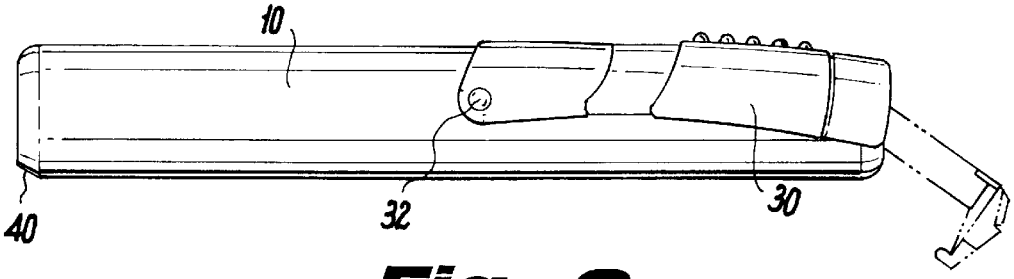
FIG. 2 is a side plan view of the weighted handle device shown in FIG. 1.
Figure 3:
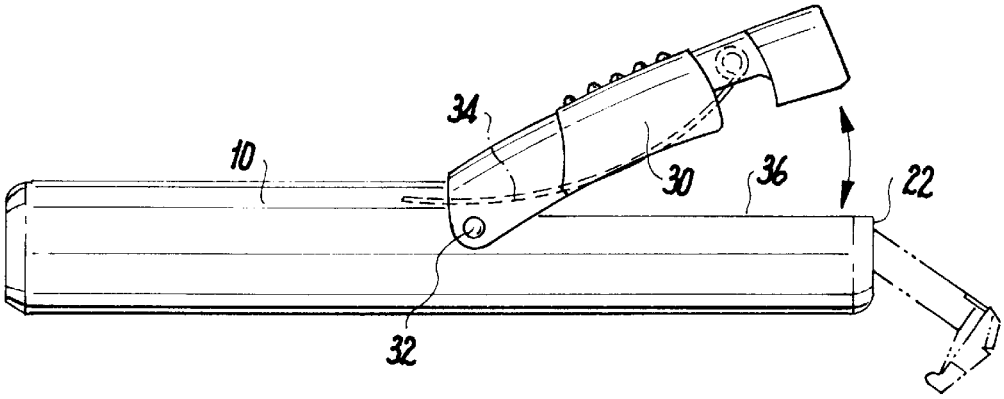
FIG. 3 is a side plan view of the weighted handle device shown in FIG. 1.
Figure 4:
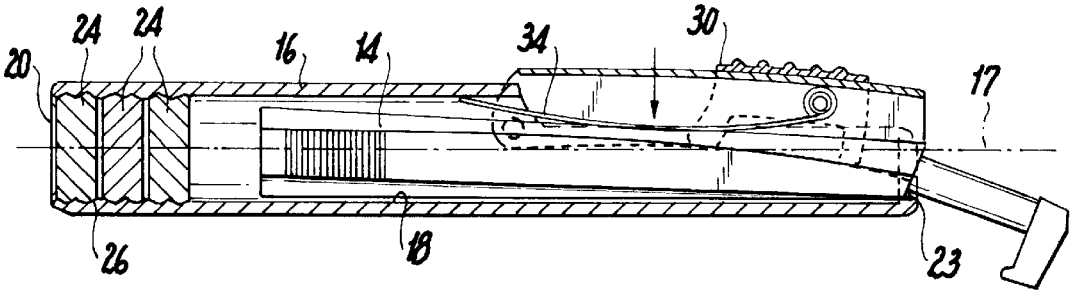
FIG. 4 is a side cross-sectional view of the weighted handle device shown in FIG. 1.

Referring now to FIGS. 1 and 3, a weighted handle 1 for razors, particularly disposable razors, is shown. Weighted handle 1 is generally formed as a hollow cylindrical tube 10 having at its upper portion an indentation 36. Tube 10 has substantially along a bottom portion thereof outer surface 16 and inner surface 18 about axis 17, as shown in FIG. 4. Indented portion 36 accommodates pressure lever 28, which functions to secure razor 12 in the weighted handle 1. Pressure lever 28 has thumb lever 30 and stainless steel spring 34, and is secured to tube 10 by pivot 32.

Tube 10 further has a bottom end 20 and a top end 22. Although shown with a circular cross-section, this invention contemplates that tube 10 may have a non-circular cross-section, for example, a rectangular or ergonomic or other type cross-section is contemplated. Seat gasket 23 is positioned at the top end, and may be formed from rubber or other like material for securing the razor and for preventing water, shaving cream, soap or other material from entering tube 10. Further, top end 22 is open to allow for the insertion of razor 12 within tube 10, as shown.

As best shown in FIG. 4, razor 12 has an elongated handle 14 and is inserted in the top portion of tube 10 via top end 22 or indented portion 36 such that it is held in place by pressure lever 28 and gasket 23.

Handle device 1, and in particular the tube 10 thereof, may be made from plastic or die cast metal or aluminum or material. The pressure lever 28 may be formed from injection molded plastic parts and have a stainless steel locking spring 34. Thus, the handle is designed to be impervious to water, chemicals or corrosion. Drain hole(s) which allow for the escape of unwanted water, soap, shaving cream, etc., may be provided in cap at bottom end 20.

Bottom end 20 of tube 10 is open such that a weight or weights 24 may be threaded into the bottom portion of tube 10 through the open end 20. Internal threads 26 are thusly provided on the internal surface 18 of tube 10. It should be noted that securing weight or weights 24 by threads is one of the many options contemplated. For example, weight or weights 24 and internal surface 18 alternatively may be non-threaded, and the weight or weights secured within tube 10 by an end cap at bottom end 20. As a further alternative, weight or weights 24 may be secured within tube 10 via O-rings or other suitable apparatus whereby the weight or weights 24 are snapped, clipped or otherwise secured within tube 10.

The weight and balance of the assembly may thus be affected by the number and/or position of weights placed in tube 10. Specifically, the present invention allows the user to shave without struggling to determine how much pressure to apply to the face. Because the weight of the handle 1 is substantial, as compared to on ordinary disposable razor, and because the weight can be increased by inserting additional weights or weighted discs, the user experiences a better shave. In addition, the added weight or weighted discs may be secured at varying positions within tube 10, thus further refining the degree of control imparted to the user by the handle of the present invention. The provision of a weighted handle and extra weights or weighted discs allows the user to focus on the handle, which in turn allows the user to have increased control. A further benefit of the present invention is that a disposable razor will last longer when used with the handle of the present invention.

Preferably, the handle 1 is between approximately 0.7 to 0.8 inches in diameter and between approximately 4.5 to 5.0 inches in length. The weight range of the handle 1 is between approximately 4–9 ounces, depending on, for example, the number of weights 24 inserted therein, and the weight of the disposable razor 12. Preferably, the weight of the handle 1 alone is between 3.5 to 4.5 ounces, whereas the weight of an ordinary disposable razor typically is approximately 0.5 ounces. Preferably, the weight of each weight 24 is between 1 and 1.5 ounces. Thus, in the preferred embodiment, the insertion of three weights would add an additional 3 to 4.5 ounces to handle 1. It should be noted that these values and value ranges are approximate, and that variations thereof will be suggested to those of skill in the art based on the teachings set forth herein.

Also, as shown in the Figures, tube 10 may conveniently have near its bottom end 20 an angled edge 40 which facilitates balanced standing of the handle 1 when, e.g., not in use or when the user momentarily sets down the handle.

The handle device of the present invention may be used as an attachment for virtually any of the wide variety of disposable-type razors sold, regardless of size or dimension.

In operation, the user slides thumb lever 30 down toward the bottom of handle 1. This releases pressure lever 28 and stainless steel spring 34, which swing away about pivot 32 to allow access into tube 10 via indented portion 36. The user then inserts the razor 12, which may be any of the disposable-type razors commonly sold, into indented portion 36, such that it is seated against gasket 23, which may be a U-shaped rubber seating gasket. Pressure lever 28 is then moved, about pivot 32, and against the handle of a razor 12 to secure the handle of a razor 12 within tube 10. Thumb lever 30 is moved upward to lock securely the razor 12 in place.

Having described the presently preferred exemplary embodiment of a new weighted handle for razors, in accordance with the present invention, it is believed that other modifications, variations and changes will be suggested to those skilled in the art in view of the teachings set forth herein. It is, therefore, to be understood that all such modifications, variations and changes fall within the scope of the present invention as defined by the appended claims.

What is claimed is:

1. An auxiliary handle device for adding weight-feel to a light weight disposable razor having an elongated handle, said auxiliary handle device comprising an elongated tube, said tube having a top end and a bottom end and having a length between said top end and said bottom end sufficient to receive therein substantially the entire elongated handle of the razor inserted in said tube, and means for selectively engaging the razor handle for securing the elongated razor handle in said tube, said means comprising a pressure lever that is operative to act on the razor handle to secure the razor in the tube.

2. A handle device as claimed in claim 1, wherein said pressure lever acts directly on the razor handle.

3. A handle device as claimed in claim 1, wherein said tube is formed having a cut-out portion substantially along an upper portion thereof capable of accommodating said pressure lever, and wherein said cut-out portion accommodates the pressure lever.

4. An auxiliary handle device for adding weight-feel to a disposable razor having an elongated handle, said handle device comprising an elongated tube having a top end and a bottom end, said bottom end being open for insertion of at least one weight therein, an elongated interior cavity between said top end and said bottom end of a length sufficient to receive therein substantially the entire handle of the disposable razor inserted in said tube, and a pressure lever operative to act on the razor handle to secure the razor in said tube.

5. A handle device as claimed in claim 4, wherein said pressure lever acts directly on the razor handle.

6. An auxiliary handle device for adding weight-feel to a light weight disposable razor having an elongated handle, said auxiliary handle device comprising an elongated tube, said tube having a top end and a bottom end and having a length between said top end and said bottom end sufficient to receive therein substantially the entire elongated handle of the razor inserted in said tube, and means for selectively engaging the razor handle for securing the elongated razor handle in said tube, said bottom end of said tube being open for insertion of at least one weight therein, and wherein said at least one weight is secured within said tube by an O-ring.

7. An auxiliary handle device for adding weight-feel to a disposable razor having an elongated handle, said handle device comprising an elongated tube having a top end and a bottom end, said bottom end being open for insertion of at least one weight therein, said handle device defining an elongated interior cavity between said top end and said bottom end of a length sufficient to receive therein substantially the entire handle of the disposable razor inserted in said tube, and wherein said at least one weight is secured within said tube by an O-ring.

* * * * *